United States Patent [19]

Takahashi et al.

[11] 4,351,738

[45] Sep. 28, 1982

[54] YARN TREATING COMPOSITION FOR HIGH-SPEED FRICTION DRAW-FALSE TWIST TEXTURING AND A FILAMENTARY YARN TREATED WITH THE SAME

[75] Inventors: Masao Takahashi, Mihara; Katumi Yoshida; Shinji Ohwaki, both of Matsuyama; Hiroyuki Moriga, Mihara, all of Japan

[73] Assignee: Teijin Limited, Osaka, Japan

[21] Appl. No.: 180,177

[22] Filed: Aug. 21, 1980

[30] Foreign Application Priority Data

Aug. 21, 1979 [JP] Japan ..... 54-105467

[51] Int. Cl.[3] ..... D06M 15/10; D06M 15/68

[52] U.S. Cl. ..... 252/8.75; 252/8.7; 252/8.8; 252/8.9; 428/395

[58] Field of Search ..... 252/8.7, 8.75, 8.8, 252/8.9; 428/395

[56] References Cited

U.S. PATENT DOCUMENTS 2,740,759 4/1956 Maeder et al. ..... 252/8.75
3,963,628 6/1976 Park ..... 252/8.9
3,977,979 8/1976 Crossfield et al. ..... 252/8.8
4,264,457 4/1981 Beeks et al. ..... 252/8.75

*Primary Examiner*—Maria Parrish Tungol
*Attorney, Agent, or Firm*—Sughrue, Mion, Zinn, Macpeak & Seas

[57] ABSTRACT

A yarn treating composition useful for application to a filamentary yarn for high-speed friction draw-false twisting. This composition comprises substantially a polyether having a molar copolymerization ratio between propylene and ethylene oxides of 35:65–90:10 and an average molecular weight of 1,000 to 15,000, and small amounts of anionic compounds. The anionic compounds are used in the form of a mixture of salts of specific dicarboxylic acid derivatives with phosphate compounds and/or sulfonate compounds. The application of said treating composition to yarns provides a reduction of fluctuation in friction between the yarns and rollers, guides, etc. and of frictional resistance at a high running speed, improvement in threading property in false twisting, and a sharp decrease in scum deposits on heaters.

6 Claims, No Drawings

YARN TREATING COMPOSITION FOR HIGH-SPEED FRICTION DRAW-FALSE TWIST TEXTURING AND A FILAMENTARY YARN TREATED WITH THE SAME

BACKGROUND OF THE INVENTION

1. Field of the Invention

This invention relates to a yarn treating composition useful in friction draw-false twist texturing of synthetic filamentary yarns such as polyamide or polyester yarns. More particularly, it relates to a yarn treating composition wherein scum deposition is scarcely any observed on a high-temperature heater in friction draw-false twist texturing at a high speed.

2. Description of the Prior Art

Synthetic filamentary yarns such as polyamide or polyester yarns have been recently drawn and false twisted simultaneously. The adoption of the friction false twisting method (hereinafter referred to as the "friction method") has remarkably increased the draw-false twisting speed compared with the conventional spindle method. Even with the friction method, the speed has been further increased due to the development of various mechanical devices, and recently directed rapidly from 400 m/min or higher up to 1000 m/min. However, yarns are frequently exposed to severer conditions because of the increased heat-treating temperature due to the increases in contact pressure at areas of contact between the yarns and various substrates, for example, guides, rollers, and heaters, and in texturing speed with increasing texturing speed. For example, the friction between the yarns and various substrates increases greatly with increasing texturing speed, and as a result the yarns are damaged to increase the occurrence of snow powder comprising oligomers and the like, fluffs, and broken yarn, thus deteriorating the processability. Furthermore, the increased speed of rotating bodies resulting from the increase in the yarn speed extremely deteriorates the operating efficiency, such as threading property. The false twisting speed, which increases more remarkably corresponding to the increasing texturing speed, applies very great centrifugal force to yarns, and the conventional well-known treating agent is squeezed out from the surfaces of yarns and shaken off, and the amount to be splashed on the heater is increased. As a result, the heater is considerably stained, and in the extreme, the disadvantage of so-called "tar flowing" wherein the agent flows through the heater groove occurs. Gels or non-volatile sludge residues on the heater resulting from components subject to thermal decomposition in the agent markedly deteriorate the frictional properties of the yarns to cause fluffing in texturing, or abnormal crimping, eventually resulting in yarn breakage. Thus, in order to increase the productivity, the heater must be cleaned frequently. However, the frequent cleaning of the heater adversely deteriorates the productivity, thus incurring the high cost. For solving the problems described above, heat-resistant finish oils have been studied recently, and finish oils consisting mainly of various polyether compounds have been proposed extensively. In more detail, lubricants consisting of a copolymer of propylene and ethylene oxides have long been known, and their general properties have been clarified. On closer investigations, the change in copolymerization ratio generally changes considerably the properties of the copolymer even of propylene and ethylene oxides.

For example, the behavior of the copolymer depends largely on the number of end groups, copolymerization ratio between propylene and ethylene oxides, the molecular weight, and additives. In general, the copolymer of propylene and ethylene oxides is soluble in water, and the high copolymerization ratio of ethylene oxide increases the water-solubility, while the tendency to increase the residue after heating has been verified experimentally. In contrast, a copolymer of high copolymerization ratio of propylene oxide exhibits such characteristics that the cloud point is lowered considerably at a specific ratio or higher and the aqueous solution becomes very unstable. Finally, a stable aqueous solution cannot be obtained without an emusifier. Consequently, the copolymer of propylene and ethylene oxides involves extensive problems to be defined corresponding to individual technical subjects to be solved.

To illustrate the problems described above more fully, the copolymer of ethylene and propylene oxides is generally stable to oxidation or thermal decomposition at 200° C. or below, however, decomposed by a long-term exposure to a temperature of 200° C. or above. After the decomposition, the copolymer forms residues such as sludges or varnishes, and further deposits. It has been known that the copolymer forms less sludges than mineral oil and synthetic ester compounds. Polyethylene glycol consisting solely of ethylene oxide among polyether lubricants, however, forms more sludges after heating than the copolymer of propylene and ethylene oxides, and cannot be used as a base for treating agents in high-speed texturing. However, it has been found that the copolymer of higher copolymerization ratio of propylene oxide, namely, of molar ratio between propylene and ethylene oxides (hereinafter referred to as PO/EO) of 35:65 or higher, i.e. the propylene oxide content of 35 mole % or higher, may be sufficiently used to reduce the sludge residues. Nevertheless, the characteristics described above are not directly suitable to the agent for treating high-speed false twisting yarns. The operating conditions and processability are still unstable even with said polyether lubricant alone. Therefore, an antistatic agent is usually mixed in use. However, anionic, nonionic, other cationic, or ampholytic surfactants well known as antistatic agents in amounts described in examples of the specifications of Japanese Patent Publication No. 52-47079 (1977) and Japanese Patent Laid-open No. 50-155796 (1975) for the well-known finish oils deposit scums on heaters in high-speed texturing for several hours to several days. The tar formation deteriorates the frictional properties of yarns markedly. Consequently, scum deposits on heaters can be reduced simply by decreasing the amount of the antistatic agent. With 4.0% or less of the agent, the scum deposits on heaters are reduced more than with about 10 to 15%; however, the initial threading property and processability become unstable. For example, a composition comprising 2 to 50% based on the polyether lubricant of anionic surfactants, such as one or two or more compounds selected from sodium or potassium salt of lauric, palmitic or oleic acid of the general formula $$R-\overset{\overset{\displaystyle O}{\|}}{C}-OM,$$

and/or sodium or potassium salt of octylphosphonic, laurylphosphonic, or oleylphosphonic acid, sodium or potassium salt of polyoxyethylene (3 moles) laurylphosphonic acid of the general formula $$[RO(CH_2CH_2O)_n]_xP(\overset{\overset{\displaystyle O}{\|}}{O}M)_{3-x},$$

and/or sodium or potassium salt of polyoxyethylene (3 moles) cetyl sulfate of the general formula $$RO(CH_2CH_2O)_nSO_3M,$$

is proposed in the specification of Japanese Patent Publication No. 52-47079 (1977). In this case, the large amount of the surfactant increases scum deposits on heaters naturally, and the processing stability is not good in the range of 2% by weight to 4.0% by weight inclusive possibly due to the insufficient antistatic properties at a high speed. Accordingly, in general 6.0% by weight or more of an anionic surfactant is often used to effect the stable texturing.

The specification of Japanese Patent Laid-open No. 50-155796 (1975) discloses a finish oil consisting of 35 to 95% by weight of a polyether lubricant, 4 to 50% by weight of an ordinary nonionic surfactant consisting of an ether or ester of a polyoxyethylene having long-chain alkyl groups, 1 to 30% by weight of a metal salt of a polyethylenepolypropylene glycol higher alcohol ether phosphate, and 1 to 30% by weight of a metal salt of an alkylsulfonate.

According to the proposal described above, an anionic and a nonionic surfactants are always present together, and scum deposits on heaters cannot be easily reduced even by the use of 1 to 4% by weight of an anion salt in high-speed texturing.

SUMMARY OF THE INVENTION

An object of the present invention therefore is to provide a yarn treating composition capable of reducing the fluctuation of friction between yarns and contact bodies, lowering the frictional resistance, further improving the initial threading property in high-speed false twisting, and markedly reducing the snow powder comprising oligomers and so forth likely to form around the machine in texturing with a friction false twister at a high speed, whereby the operating efficiency is improved and the stable processability of textured filament yarns, such as tensile strength and elongation, crimpability, and level dyeing property can be obtained.

As a result of intensive research made to overcome the problems, such as scum deposition on heaters, processability, and operating efficiency, and antistatic properties, in high-speed texturing with a minimum amount of an antistatic agent, the present inventors have found that factors such as electrostatic stability of the whole finish oil, or solubility and dispersibility of antistatic agents to be used in the polyether acted very critically. From the viewpoints described above, the present inventors have made further research on antistatic agents to be used ideally together with the polyether, and have found that the desired effect of the whole finish oil can be produced surprisingly by the use of a metal salt of a long-chain monoolefinic dicarboxylic acid or an amino-dicarboxylic acid with an anionic phosphate or sulfonate surfactant, thus completing the present invention.

The present invention provides a yarn treating composition for high-speed friction draw-false twisting comprising substantially [A] a polyether lubricant component and [B] an anionic component, wherein [A] said polyether lubricant component consists of one or two or more types of random or block copolymers having a molar copolymerization ratio between propylene and ethylene oxides of 35:65–90:10, and an average molecular weight in the range of 1,000 to 15,000 both inclusive, and is incorporated in the composition in an amount of 96% by weight or more, and [B] said anionic component is a mixture of compounds [I] with [II] and/or [III] as defined below, said compounds [I], [II], and/or [III] being incorporated in the composition in amounts ranging from 0.5% by weight to 4.0% by weight both inclusive, said compounds [I] being selected from the following groups (b-1), (b-2), and (b-3):

(b-1): alkali metal, ammonium, organic amine salts, or their mixtures of long-chain monoolefinic dicarboxylic acids, obtained by addition of long-chain monoolefin having 8 to 18 carbon atoms with dicarboxylic acids having double bonds, or anhydrides thereof and/or ester derivatives each having at least one carboxyl group in the molecule, obtained by reacting said long-chain monoolefinic dicarboxylic acids or the corresponding dicarboxylic acid anhydrides with compounds having one or more hydroxyl groups in the molecule, (b-2): (a) alkali metal, ammonium, or organic amine salts of (b) dicarboxylic derivatives having long-chain alkyl ether, long-chain alkyl thioether, or long-chain alkyl ketone groups, obtained by reacting (c) dicarboxylic acids having double bonds, anhydrides, or diesters thereof with (d) compounds having active hydrogen atoms selected from the group consisting of aliphatic alcohols, aliphatic alkyl mercaptans, and aliphatic aldehydes, having 8 to 18 carbon atoms on the average and/or (e) alkali metal, ammonium, or organic amine salts of (f) ester compounds each having at least one carboxyl group, obtained by reacting (b) said dicarboxylic derivatives thereof with (g) compounds having at least one hydroxyl group in the molecule, (b-3): alkali metal, ammonium, alkanolamine, or alkylamine salts of compounds of the general formula (1):

$$R-Z-NH.\underset{\underset{\displaystyle (CH_2)_b-COOH}{|}}{CH}-COOH \qquad (1)$$

where R is an alkyl, alkenyl, or fluoroalkyl group having 8 to 22 carbon atoms; n is a positive integer 1 or 2; Z is —CO— or —$SO_2$—, obtained by reacting amino-dicarboxylic acids or derivatives thereof with aliphatic acyl halides or sulfochlorides, and/or alkali metal, ammonium, or organic amine salts of ester compounds each having at least one carboxyl group, obtained by from esterification of said compounds defined above or anhydrides thereof with compounds having at least one hydroxyl group in the molecule; compounds [II]: alkali metal, ammonium, or organic amine salts of phosphates having higher alkyl or aralkyl polyoxyalkylene ether groups; and compounds [III]: amino, organic amine, or alkali metal salts of sulfonate compounds each having at least one alkyl group and sulfonic acid group respectively in the molecule.

DETAILED DESCRIPTION OF THE INVENTION

It is not a case of the present invention that any polyethers consisting of the well-known copolymer of propylene and ethylene oxides, may be used as the lubricant component [A] incorporated in the treating composition of the present invention. The lubricant component [A] should consist of one or two or more random or block copolymers having a molar copolymerization ratio between propylene and ethylene oxides of 35:65–90:10, in relation to the anionic compounds of component [B] to be incorporated with the polyethers, and an average molecular weight of 1,000 to 15,000. The present invention is characterized in that emulsifiers often used as a mixed finish oil are not employed to reduce the scum deposition on heaters extremely even in high-speed texturing. Polyethers having the self-emulsifying characteristics or almost self-emulsifying ones dispersible with 0.5 to 4.0% by weight of anionic compounds of component [B] are used as the lubricant [A]. However, for purposes entirely different from emulsification, a small amount of a volatile emulsifier may be used. On the other hand, a very high copolymerization ratio of EO in the PO/EO provides the sufficient water-solubility fundamentally without requiring any emulsifier. Polyethylene glycol or polyether compounds having a low PO ratio increase scum deposits on heaters substantially in false twisting, and an excessively high EO ratio is undesirable. Therefore, the lubricant [A] is limited to polyethers having a molar ratio of PO/EO of 35:65–90:10. More particularly, in the preferred example of the present invention, one or more two or more types of random and/or block copolymers each having an average molecular weight in the range of about 1,000 to 15,000, preferably 2,000 to 10,000, are mixed in use as the polyethers. In order to further smooth the frictional behavior of fiber surfaces in the range of room to high temperatures, one or more types of copolymers having a relatively low molecular weight of about 1,000 to 4,000 and a molecular weight of about 5,000 to 15,000 respectively are mixed at a weight ratio of 10:90–90:10 in use. A copolymer having an average molecular weight lower than 1,000 increases the smoking, and scum deposits on heaters cannot be reduced sharply with ease in the case of an average molecular weight higher than 15,000. Furthermore, the increased viscosity adversely deteriorates the operating efficiency considerably. Random copolymers having a lower inversion viscosity have advantages over block copolymers; however, there is no special limitation.

Compounds having active groups reactive with a mono- or polyhydric alcohol, mono- or polycarboxylic acid, mono- or polyfunctional amine, mercaptan, or ethylene or propylene oxide by the conventional method may be employed as end groups of the polyethers to be used in the present invention. Although the type and number of the end groups of the polyethers are not particularly limited, a compound having a boiling point of 200° C. or below is most preferred, for example a lower monohydric alcohol such as butanol is much better than a polyhydric or hexahydric one such as sorbitol, as the compound of the end groups.

The number (n) of the end groups is preferably small, and the smaller the n value, for example $6>5>4>3 \ldots >1$, the better.

The essential component [B] to be used together with said polyether lubricant [A] will be illustrated as follows:

Compounds [I]

group (b-1): alkali metal, ammonium, organic amine salts, or their mixtures of long-chain monoolefinic dicarboxylic acids, obtained by addition of an olefin having 8 to 18 carbon atoms with dicarboxylic acids having double bonds or anhydrides thereof, and/or ester derivatives each having at least one or more carboxyl groups, obtained by reacting said monoolefinic dicarboxylic acids or the corresponding long-chain monoolefinic dicarboxylic acid anhydrides with compounds having at least one hydroxyl group in the molecule. In more detail, maleic, itaconic, citraconic, or glutaconic acid, or acid anhydrides thereof may be cited as the dicarboxylic acids having one double bond in the molecule or their anhydrides to obtain long-chain monoolefinic dicarboxylic acids, and more preferably maleic anhydride is used.

Examples of the olefin to be reacted with the dicarboxylic acids or anhydrides thereof include olefins having 6 to 18 carbon atoms, for example octene, isooctene, nonene, dodecene, pentadecene, or octadecene. Both of them are subjected to addition in an inert gas to form long-chain monoolefinic dicarboxylic acids, which are further neutralized with an alkali metal hydroxide, such as sodium or potassium hydroxide, or with ammonia or an organic amine such as alkanolamine or alkylamine. Example of the former are tri- or diethanolamine, and the latter comprises triethyl-, tributyl-, or laurylamine.

Ester derivatives of the monoolefinic dicarboxylic acids mentioned above are obtained by reacting the long-chain monoolefinic dicarboxylic acids or anhydrides thereof with compounds having hydroxyl groups, for example various saturated or unsaturated alcohols each having 4 to 18 carbon atoms, such as butanol, octanol, lauryl, oleyl, or stearyl alcohol, and further natural alcohols derived from coconut oil or beef tallow, or synthetic alcohols prepared by the Ziegler or oxo process. Examples of compounds having two or more hydroxyl groups include ethylene glycol, 1,6-hexanediol, neopentyl glycol, propanediol, trimethylolpropane, and pentaerythritol. Examples of compounds having hydroxyl and carboxyl groups in one molecule, i.e. hydroxy-carboxylic acids, include glycolic, lactic, 2-hydroxyhexanoic, hydroxybutenoic, ricinoleic, and malic citric, glyceric, and tartaric acids. Esters of alcohols with hydroxy acids, for example methyl ricinoleate, may also be used.

Ester derivatives thus obtained have at least one carboxyl group in the molecule, and the carboxyl group is neutralized with an alkali metal, ammonium, or organic amine salt, most preferably a potassium or sodium salt.

Examples of compounds suitable for use in the present invention include potassium salt of addition polymer of propylene pentamer with maleic anhydride, sodium salt of addition polymer of isobutylene tetramer with maleic anhydride, potassium salt of 1-octadecene addition polymer with itaconic acid, monopotassium salt of 2-ethylhexanol monoester of nonene addition polymer with maleic anhydride, sodium salt of ricinoleyl alcohol diester of pentadecene addition polymer with maleic anhydride, dipotassium salt of 1,2-hydroxyoctadecanoic acid monoester of octadecene addition polymer with maleic anhydride, dipotassium salt of lactic acid monoester of octadecene addition polymer with maleic anhydride, and dipotassium salt of propenediol monoester of pentadecene addition polymer with maleic anhydride. However, this invention is not limited to the compounds described above. group (b-2): This group comprises compounds (a) or (e).

Compounds (a) are used in the form of alkali metal, ammonium, or organic amine salts of compounds (b), obtained by reacting compounds (c) with (d). Compounds (e) are in the form of alkali metal, ammonium, or organic amine salts of compounds (f), obtained by reacting the compound (b) with (g). Compounds will be exemplified hereafter.

Compounds (c):

Maleic, itaconic, citraconic, glutaconic, cis-4-cyclohexene-1,2-dicarboxylic acids, and anhydrides, or lower alkyl diesters such as methyl or ethyl ester thereof, may be cited as the dicarboxylic acids having a double bond, anhydrides, or diesters thereof, and most preferably maleic acid or its lower alkyl diester is used.

Compounds (d):

(i) Higher alcohols, such as octyl, lauryl, cetyl, and stearyl alcohols, may be cited as aliphatic alcohols having 8 to 18 carbon atoms on the average.

(ii) Caprylic, lauric, palmitic, and stearic aldehydes may be cited as aliphatic higher aldehydes having 8 to 18 carbon atoms on the average.

(iii) Capryl, lauryl, palmityl and stearyl mercaptans may be cited as higher aliphatic alkyl mercaptans having 8 to 18 carbon atoms on the average.

As an example of the reaction between compounds (c) and (d), compounds of group (b-2) can be obtained by reacting higher alcohols with diethyl maleate in the presence of a free radical catalyst, according to the well-known method, for example as described in the specification of U.S. Pat. No. 2,377,246.

As in the case of the higher alcohols, the compounds of group (b-2) can be readily obtained by reacting higher aliphatic aldehydes with diethyl maleate in the presence of benzoyl peroxide as a radical initiator at 100°–180° C.

Higher aliphatic methyl mercaptans can be reacted with diethyl maleate by the ultraviolet irradiation or with a tertiary amine as described in The Journal of Organic Chemistry, 31, 830–835 (1966) by A. A. Oswald et al.

Compounds (b), obtained by adding compounds (d) to the double bond of di-arboxylic acids (c), are generally in the form of ester derivatives, and then hydrolyzed with an alkali hydroxide such as lithium hydroxide, caustic soda or potash, or as an alkali metal salt. Dicarboxylic acids formed by neutralization can be dehydrated to give acid anhydrides. Ammonium or organic amine salts can be obtained by neutralizing the salts with ammonia, or an organic amine hereinbefore exemplified. The methods described above are only an example in preparation of the compounds of group (b-2). Dicarboxylic acid compounds, of course, can be obtained directly by radical addition of maleic anhydride, and nothing is limited about the method of preparation.

Thus, the compounds (g) each having at least one hydroxyl group in the molecule alone or mixtures thereof may be used as hydroxyl group-containing compounds to be employed for preparing ester compounds (f) from dicarboxylic acid derivatives (b) having long-chain alkyl ether, alkyl thioether, or alkyl ketone groups, obtained by reacting at least one type of alkyl compounds (d) having active hydrogen atoms selected from aliphatic alcohols, alkyl mercaptans, or aldehydes having 8 to 18 carbon atoms on the average with dicarboxylic acids, having double bonds, anhydrides thereof, or dicarboxylic acid diesters (c).

Various alcohols, for example butanol, octanol, 2-ethylhexanol, decyl, tridecyl, tetradecyl, and octadecyl alcohols, natural alcohols made from coconut oil or beef tallow, synthetic alcohols made by the Ziegler or oxo process, may be used as the compounds (g) described above. Furthermore, various polyhydroxy compounds having two or more hydroxyl groups, for example 1,6-hexanediol, neopentyl glycol, 9,10-dihyroxystearyl alcohol, trimethylol propane, or pentaerythritol, or ricinoleyl alcohol or acetylenediol having an unsaturated bond in the molecule may also be used as the compounds (g). Most preferably, hydroxy acids having hydroxyl or carboxyl groups in one molecule or their esters with alcohols may be used, for example monohydroxy-carboxylic acids, such as glycolic or lactic acid, monohydroxypolycarboxylic acids, such as maleic or citric acid, or dihydroxycarboxylic acids, such as glyceric or tartaric acid, may be cited. Further, esters of hydroxy acids with alcohols, such as methyl ricinoleate, may be used. In order to produce the desired effects, the ester compounds must be salts obtained by neutralizing at least one carboxyl group or saponifying the ester parts of the compounds. The degree of neutralization or saponification may be either complete or partial. Alkali metal, ammonium, or organic amine salts may be herein cited as the salts, and in this case they may be mixed salts having two or more types of salts in the same molecule.

Sodium, potassium, or lithium salts may be cited as the alkali metal salts, and preferably sodium or potassium salts are used. Salts of alkanolamines, such as mono-, di-, dibutyl-, and triethanol amines, and of alkylamines, such as triethyl-, tributyl-, oleyl-, and octylamines, may be cited as the organic amine salts.

Compound suitable for use in the present invention are enumerated as follows:

Disodium salt of stearyloxysuccinic acid, disodium salt of lauryloxysuccinic acid, dipotassium salt of lauryloxysuccinic acid, disodium salt of lauroylsuccinic acid dispotassium salt of stearoylsuccinic acid, disodium salt of caproylsuccinic acid, disodium salt of laurylthiosuccinic acid, dipotassium salt of stearylthiosuccinic acid, disodium salt of laurylalcohol itaconic acid, dipotassium salt of lauryl mercaptan adduct with itaconic acid, salt of lauroyl succinic acid monoester with 2-ethylhexanol, and dispotassium salt of laurylthiosuccinic acid ester with lactic acid. However, the compounds of group (b-2), of course, are not limited to those described above. group (b-3): The compounds comprise alkali metal, ammonium, or organic amine salts (or their mixtures) of compound expressed by the general formula (1):

$$R-Z-NH.\underset{\underset{(CH_2)_n-COOH}{|}}{CH}-COOH \qquad (1)$$

where R is an alkyl, alkenyl, or fluoroalkyl group having 8 to 22 carbon atoms; n is a positive integer 1 to 2; Z is —CO— or —$SO_2$—, obtained by reacting aliphatic acyl halides or sulfochlorides with aminodicarboxylic acids or derivatives thereof, and/or alkali metal, ammonium, or organic amine salts (or their mixture) of ester compounds each having at least one or more carboxyl groups, obtained by reacting the dicarboxylic acids of the formula (1) or anhydrides thereof with compound having hydroxyl groups in the molecule.

As a detailed example in preparation of the compounds of group (b-3) described above, the well-known aminodicarboxylic acids of the general formula (2):

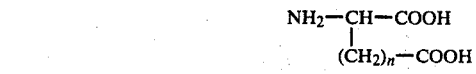

$$NH_2-\underset{\underset{(CH_2)_n-COOH}{|}}{CH}-COOH \quad (2)$$

where n is a positive integer 1 or 2, are reacted with fatty acid halides or aliphatic sulfochlorides of the general formula (3):

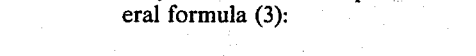

$$R-COCl \text{ or } R-SO_2Cl \quad (3)$$

where R is an alkyl, alkenyl, or fluoroalkyl group having 8 to 22 carbon atoms, by the well-known methods. For example, aspartic, glutamic acids, etc. may be cited as the aminodicarboxylic acids specifically. On the other hand, ordinary higher fatty acid chlorides having 8 or more carbon atoms may be used as the acid chlorides, and fluorofatty acid derivatives wherein hydrogen atoms are substituted by fluorine atoms may be used in the same manner. Sulfochlorides, obtained by halogenating the corresponding sulfonic acids according to the well-known methods, may be used as the compounds of the formula (3).

Compounds of the general formula (1) can be prepared by reacting compounds of the general formulas (2) and (3) in the presence of a dehydrochlorinating agent to form unneutralized compounds of the general formula (1), which are then neutralized with an alkali hydroxide, such as lithium hydroxide, caustic soda or potash, ammonia, or an organic amine mentioned before. The compounds of the general formula (1), of course, can be prepared by other methods, for example aminodicarboxylic esters are used, and the reaction products are hydrolyzed. Nothing is limited about the method of preparation in the present invention.

Furthermore, the compounds of the general formula (1) described above may be used in the form of esters with compounds having at least one hydroxyl group. In this case, the compounds having at least one hydroxyl group for forming the esters derived from the compounds of the general formula (1) mentioned above are compounds each having at least one hydroxyl group in the molecule alone or mixtures thereof. Thus, various alcohols, for example butanol, octanol, 2-ethylhexanol, decylalcohol, tri-, tetra-, or octa-decyl alcohol, natural alcohols made from coconut oil or beef tallow, or synthetic alcohols made by the Ziegler or oxo process may be used. Various polyhydroxy compounds having two or more hydroxyl groups, for example 1,6-hexanediol, neopentyl glycol, 9,10-dihydroxystearyl alcohol, trimethylolpropane, or pentaerythritol, or ricinoleyl alcohol or acetylenediol having an unsaturated bond in the molecule may also be used. Most preferably, hydroxy acids having hydroxyl and carboxyl groups in one molecule or their esters with alcohols are used. For example, monohydroxycarboxylic acids, such as glycolic and lactic acids, monohydroxypolycarboxylic acids, such as malic and citric acids, and other dihydroxycarboxylic acids, such as glyceric and tartaric acids, may be cited. Furthermore, esters of hydroxylic acids with alcohols, for example methyl sicinoleate, may be used. In order to obtain the desired effects, the ester compounds must be salts which are obtained by neutralizing at least one carboxyl group or by saponifying the ester parts of the compounds. The degree of neutralization or saponification may be either complete or partial. Alkali metal, ammonium, or organic amine salts may be herein cited as the salts, and they may be mixed salts having two or more types of salts in the same molecule. Sodium, potassium, or lithium salts may be cited as the alkali metal salts, and preferably sodium or potassium salts are used. Salts of alkanolamines, such as mono-, di-, dibutyl-, and triethanolamines, and alkylamines, such as triethyl-, tributyl-, oleyl-, and octylamines, may be cited as the organic amine salts.

Compounds suitable for use in the present invention are enumerated as follows:

Disodium N-lauroylglutamate, dipotassium N-lauroylaspartate, dipotassium N-octanoylaspartate, disodium N-perfluorooctanesulfonyl glutamate, dipotassium salt of N-lauroylglutamic acid ester with lactic acid, sodium salt of N-oleylglutamic acid monoester with 2-ethylhexanol. However, the compounds described above are not construed as limiting the present invention.

Compounds [II]

The compounds are expressed by the following general formula

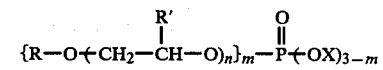

$$\{R-O(CH_2-\overset{\overset{R'}{|}}{CH}-O)_n\}_m-\overset{\overset{O}{\|}}{P}(OX)_{3-m}$$

where R is a saturated or unsaturated aliphatic group having 8 to 18 carbon atoms or alkyl-substituted aromatic group having 1 to 9 carbon atoms; R′ is hydrogen atom or methyl group, or may be a copolymer of propylene and ethylene oxides wherein hydrogen atoms and methyl groups are present; n is a positive integer 0 to 15; m is 1 or 2; X is an ammonium or organic amine salt, or alkali metal salt of sodium, potassium, or lithium; an alkyl-substituted aromatic group having 1 to 9 carbon atoms is excluded when n is 0.

Specifically, the compounds represent salts of alkyl phosphates having the well-known higher alkyl groups when n is 0, and typical examples include ammonium, triethanolamine, sodium, potassium, or lithium salts of octyl, lauryl, or oleyl phosphates. Salts of phosphates consisting of polyoxyalkylene ethers, prepared by adding ethylene or propylene oxide, or further ethylene and propylene oxides to higher alcohols or alkylphenols, may be used. The salts [II] of phosphates, though the season is unknown, are preferably ammonium salts, more preferably organic amine salts, and most preferably alkali metal salts, such as sodium or potassium salts, of phosphates, obtained from polyoxyalkylene ethers which are prepared through addition polymerization of ethylene and propylene oxides with higher alcohols or aromatic compounds substituted by alkyl groups.

Compounds [III]

Examples of the simplest sulfonate compounds include ammonium, organic amine, and alkali metal salts of alkylsulfonates having alkyl groups with 8 to 18 carbon atoms, alkanesulfonates, dodecyl- and lauryl-benzenesulfonates, nonylphenol-sulfonate, mono- or dialkylnaphthalenesulfonates, alkyldiphenyl ether sulfonates, and alkyl hydroxyphenyl ether sulfonates, and further amine, organic amine, or alkali metal salts of propyl or 2-hydroxypropylsulfonates of alkylphenoxypolyoxyalkylene having 6 to 14 carbon atoms, sulfonate salts of sulfoacetic esters, and alkyl ether sulfonates or sulfoacetic esters of polyoxyalkylene having alkyl or alkenyl groups with 8 to 18 carbon atoms, alkoxy or alkenoxysulfoalkyl ether having 8 to 18 carbon atoms, alkoxy or alkenoxy-2-hydroxypropylsulfonate, alkyl or alkenylcarboxy-2-hydroxy-propylsulfonates, sulfoalkyl esters, and sulfoacetates. However, the compounds [III] are not limited to those described above. Ammonium organic amine, or alkali metal salts of sulfonate compounds having the surface activity of at least one higher alkyl group and sulfonic acid group respectively in one molecule may also be used. The sulfonates are preferably ammonium salts, more preferably organic amine salts, most preferably alkali metal salts.

In the present invention, at least one or more of compounds [II] and/or [III] in addition to compound [I] in amounts to give 0.5 to 4.0% by weight, preferably 1.0 to 3.0% by weight, of the total anionic compounds are incorporated into component [A]. Therefore, two or more types of anionic compounds are incorporated. According to the present invention, two or more types of anionic components are incorporated to solve the inconsistent problems of developing antistatic properties sufficient to make the high-speed draw-false twisting possible and of reducing scum deposits on heaters extremely with a minimum amount of the anionic component to be added, and the synergistic effect has been secured. Although the detailed reasons for the synergistic effect is unknown, a polyether lubricant applied to filamentary yarns has great negative electrostatic charges on friction. On the other hand, the compounds [I] added brings the friction static electricity of yarns to neutralization, i.e. an electrically stable state; therefore, the processability can be improved. Individual compounds [I] in an amount of 4.0% by weight or less, however, provides the still unstable processability. The increased amount alone adversely increases scum deposits on heaters. Thus, it has now been found that the addition of at least one of compounds [II] and/or [III] to a mixture of component [A] with compounds [I] provides stable effects as described in the present invention even by the total amount of anionic components of 4.0% by weight or less. Therefore, antistatic properties, heat resistance, and the like in high-speed texturing can be improved with a minimum amount of the anionic component by adding compounds [II] or [III], preferably both of them, to compounds [I] as a base. The total amount of the anionic component is 0.5 to 4.0% by weight. In case that two anionic compounds are used, the amount of compound [I] is always 50% by weight or more based on the total amount of the anionic component. When three or more compounds are used, the amount of compound [I] is 30% by weight or more, and the ratio of compounds [II] to [III] may be about 1:1. The use of compound [I] in combination with compounds [II] and/or [III] produces the stable effects probably because the solubility and dispersibility of the anionic component in polyethers are improved, though the principle is uncertain. In this invention, the well-known nonionic surfactants (of the ester or ether type with 15 moles or less of polyoxyethylene), which has been frequently used in the past, can be employed to such a degree that the scum deposits on heaters may not be increased.

The high-speed friction draw-false twist texturing described in the present invention refers to the texturing at a yarn speed of 400 m/min or higher, preferably 600 m/min or higher. According to the present invention, marked effects are achieved even by friction false twisting at a speed of about 600 m/min or higher to 1,000 m/min, compared with the well-known finish oils.

The composition of the present invention is usually applied to filamentary yarns in the form of an aqueous emulsion in a concentration of 5.0 to 15.0% by weight, and the solid content depends on the types of yarn. For example, in the case of a polyester filamentary yarn, the solid content is in the range of 0.1 to 0.5% by weight, preferably 0.2 to 0.35% by weight, based on the weight of the yarn.

In case that the solid content is less than 0.1% by weight, uneven crimps tends to be caused due to possibly uneven application of the composition. In case that the content is more than 0.5% by weight, scum deposits tend to occur on heaters from the composition of the present invention shaken off in high-speed texturing. The yarn treating composition for high-speed friction draw-false twisting may be used for purposes, for example yarn treating agents for spindle false twisting or at any stages before spinning (including spin-texturing) and drawing synthetic fibers, other than the objects of the present invention.

Thus, according to the present invention, the use of a polyether in combination with two or more types of specific anionic antistatic agents excludes the antimony of antistatic properties and scum deposits on heaters, and permits the stable and efficient false twist texturing at a high speed.

Although the following examples will illustrate the present invention, they are not intended to limit it in any manner. Parts and percentages in the examples are by weight.

EXAMPLES 1-6 AND COMPARATIVE EXAMPLES 1-12

Compositions shown in Table 1 as 10 weight % aqueous emulsions were applied to filamentary yarns melt spun from polyethylene terephthalate at a spinning speed of 3,300 m/min to give a solid content of 0.3% by weight. The resulting undrawn, 115-denier, 36-filament yarns were draw-false twisted with an outer contact ceramic friction-type false twister comprising a disk of 45 mm in diameter at a draw ratio of 1.5, a heater temperature of 220° C., a rotational frequency of the friction disk of 6250 r.p.m., and a texturing speed of 700 m/min. The results obtained are shown in Table 1.

Scum deposits on heaters

The scum deposits on heaters were evaluated by the amounts of scums deposted after texturing for three weeks with the naked eye, and classified into ratings 5 ( , excellent), 4 (O, good), 3 (Δ, fair), 2 (Δ~×, poor), and 1 (×, bad). The smoking and tar formation were also evaluated in texturing.

Processing stability

The stability is classified into ratings in the order of 5 ( , excellent), 4 (O, good), 3 (Δ, fair), 2 (Δ~×, poor) and 1 (×, bad) between rating "5" as the most stable processing state and rating "1" as the inoperable state wherein:

rating "5" ( ) shows the state of less than 2 times occurrence of yarn breakage per one spindle during three weeks processing, and rating "1" (×) shows the state of frequent occurrence of yarn breakage of more than 20 per one spindle during three weeks processing.

TABLE 1

| Composition | | | Example of the present invention | | | | | | Comparative example | | | | | | | | | | | |
|---|---|---|---|---|---|---|---|---|---|---|---|---|---|---|---|---|---|---|---|---|
| | | | 1 | 2 | 3 | 4 | 5 | 6 | 1 | 2 | 3 | 4 | 5 | 6 | 6 | 8 | 9 | 10 | 11 | 12 |
| Component [A] lubricants, and emulsifiers | PO/EO (50/50) random copolymer butyl ether, molecular weight 2,000 | | 96.1 | 97.4 | | 98.5 | 98.5 | 97.0 | 50.0 | | 97.0 | | | | | 86.1 | 92.5 | 95.0 | | |
| | PO/EO (70/30) random copolymer glycerol ether, molecular weight 3,000 | | | | 68.0 | | | | | 50.0 | | 92.0 | 92.0 | | | | | | | |
| | PO/EO (50/50) random copolymer glycerol ether, molecular weight 6,000 | | | | 30.0 | | | | 47.0 | 47.0 | | | | | | | | | | |
| | PO/EO (50/50) random copolymer butyl ether, molecular weight 500 | | | | | | | | | | | | | | 96.1 | | | | | |
| | Polyethylene oxide, molecular weight 2,000 | | | | | | | | | | | | | 97.0 | | | | | | |
| | Diisotridecyl adipate | | | | | | | | | | | | | | | | | | 60.0 | |
| | Mineral oil 120" | | | | | | | | | | | | | | | | | | | 60.0 |
| | POE (5) nonyl phenol ether | | | | | | | | | | | | | | | | | | 37.0 | |
| | POE (3) oleyl ether | | | | | | | | | | | | | | | | | | | 13.0 |
| | POE (8) oleyl ether | | | | | | | | | | | | | | | | | | | 24.0 |
| | POE (15) stearyl ether | | | | | | | | | | | 5.0 | 5.0 | | | 10.0 | | | | |
| Component [B] | Compounds [I] [All belonged to group (b-1).] | (b-1)-1 | 1.3 | | | | | | | | | | | | 1.3 | 1.3 | | | 1.0 | 1.0 |
| | | (b-1)-2 | | 1.3 | | | | 1.0 | | | | | | 1.0 | | | 2.5 | | | |
| | | (b-1)-3 | | | 0.7 | | 0.5 | | | | | | | | | | | 5.0 | | |
| | | (b-1)-4 | | | | 0.5 | | | | | | | | | | | | | | |
| | Compounds [II] | II-1 | 1.3 | 1.3 | | | | | 3.0 | | | | | | 1.3 | 1.3 | | | | |
| | | II-2 | | | 0.7 | | | 1.0 | | | 1.5 | | | 1.0 | | | 2.5 | | 1.0 | |
| | | II-3 | | | | | 1.0 | | | | | 3.0 | | | | | | | | 1.0 |
| | Compounds [III] | III-1 | 1.3 | | | 1.0 | | | | 3.0 | 1.5 | | | | 1.3 | 1.3 | 2.5 | | 1.0 | 1.0 |
| | | III-2 | | | 0.6 | | | 1.0 | | | | | 3.0 | 1.0 | | | | | | |
| Process-ability | Scum deposits on the heater | | 0 | 0 | | 0 | 0 | | Δ | Δ | Δ | Δ~χ | Δ~χ | Δ | 0 smoking | x | Δ | Δ | x | x |
| | Processing stability | | 0 | 0 | 0 | 0 | 0 | 0 | x | Δ~χ | x | x | x | Δ | x | Δ~χ | O~Δ | Δ | x | x |

(Notes)
Compounds in component [B] are as follows:
Compounds [I]:
(b-1)-1: potassium salt of addition polymer of propylene pentamer with maleic anhydride
(b-1)-2: dipotassium salt of 12-hydroxyoctadecanoic acid monoester of octadecene addition polymer with maleic anhydride
(b-1)-3: dipotassium salt of lactic acid monoester of octadecene addition polymer with maleic anhydride
(b-1)-4: monopotassium salt of 2-ethylhexanol monoester of nonene addition polymer with maleic anhydride
Compounds [II]:
II-1: potassium octyl phosphate
II-2: potassium PO/EO 2/3 lauryl phosphate
II-3: potassium $(EO)_2$ lauryl phosphate
Compounds [III]:
III-1: sodium alkyl phosphate ($C_{12-16}$)
III-2: sodium octyl hydroxyphenyl ether sulfonate.

As is mentioned in Table 1, in Examples 1–6, scums was scarcely deposited on the heater, and the processing stability was sufficient. In Comparative examples 1–12, however, scum deposits on the heater were increased and the processing stability was insufficient. On closer comparison, in Comparative examples 1–3, the processing stability was very poor due to the lack of compounds [I] essential to the present invention, and the evaluation of scum deposits on the heater was bad due to only the small amount of anionic component. In Comparative examples 4 and 5, wherein polyethers in Comparative examples 1–3 were partly replaced by a nonionic surfactant, resulting in further increased scum deposits. In Comparative example 6, the polyether which was a polyethylene oxide increased scum deposits on the heater markedly, and was entirely different from the present invention. In Comparative example 7, the polyether in Example 1 of the present invention was a low-molecular weight one. In this case, scum deposits on the heater were reduced with increased smoking and poor processing stability (operating efficiency). In Comparative example 8, a nonionic surfactant which replaced partly the polyether in Example 1 of the present invention increased scum deposits on the heater. In Comparative example 9 of the same composition as the present invention, the anionic component in the total amount beyond the upper limit of present invention increased scum deposits on the heater slightly. In Comparative example 10, the anionic component consisted solely of the compound [I], and merely almost the same results as in Comparative example 9 were obtained. In Comparative examples 11 and 12, mineral oil or an ester, used respectively instead of polyethers, increased scum deposits on the heater in a short time and made the texturing very difficult. Thus, as apparent from the examples of the present invention, an unexpectable synergistic effect can be achieved by the use of compounds [I] and [II], [I] and [III] or a combination of compounds [I], [II], and [III] as component [B].

EXAMPLES 7–9

Compositions shown in Table 2 as 10 weight % aqueous emulsions were applied to filamentary yarns melt spun from polyethylene terephthalate at a spinning speed of 3,500 m/min to give a solid content of 0.25 to 0.4%, and 0.60% by weight or higher. The resulting undrawn, 78-denier, 36-filament yarns were draw-false twisted with an outer contact ceramic friction-type false twister comprising a urethane rubber disk of hardness 88°, 45 mm in diameter, at a draw ratio of 1.5, a heater temperature of 225° C., a rotational frequency of the friction disk of 9,375 r.p.m., and a texturing speed of 900 m/min. The results obtained are shown in Table 2.

TABLE 2

| Component | Composition | | Example of the present invention 7 | | 8 | | 9 | |
|---|---|---|---|---|---|---|---|---|
| [A] | PO/EO (70/30) random copolymer butyl ether, molecular weight 3,000 | | 55 | | | | | |
| | PO/EO (50/50) random copolymer glycerol ether, molecular weight 8,000 | | 42 | | | | | |
| | PO/EO (50/50) random copolymer butyl ether, molecular weight 3,000 | | | | 60 | | 60 | |
| | PO/EO (50/50) random copolymer glycerol ether, molecular weight 6,000 | | | | 37 | | 37 | |
| [B] | [I] | (b-1)-1 | 1.5 | | 1.0 | | | |
| | | (b-1)-2 | | | | | 1.3 | |
| | [II] | II-1 | | | 1.0 | | | |
| | | II-2 | 1.0 | | | | 1.3 | |
| [B] | [III] | III-1 | 1.0 | | 1.0 | | | |
| | | III-2 | | | | | 1.3 | |
| Process-ability | Solid content of the treating agent (% by weight) | | 0.25 | 0.65 | 0.40 | 0.60 | 0.30 | 0.70 |
| | Scum deposits on the heater | | 0 | Δ | 0 | Δ~0 | 0 | Δ |

(Notes)
The symbols of the compounds [I], [II], and [III] in component [B] are the same as in Table 1.

Consequently, the solid content of the treating composition of the present invention in the range of 0.1 to 0.5% by weight leaves extremely small amount of scums on the heater and provided improved processability. However, the solid content higher than 0.5% by weight tended to increase scum deposits on the heater.

EXAMPLES 10–11 AND COMPARATIVE EXAMPLES 13–15

The operation as in Examples 7–9 was repeated except that compositions shown in Table 3 as 10 weight % aqueous emulsions were applied to a polyester filamentary yarn to give a solid content of 0.3% by weight. The results obtained are shown in Table 3.

TABLE 3

| | Composition | Example of the present invention 10 | 11 | Comparative example 13 | 14 | 15 |
|---|---|---|---|---|---|---|
| Component [A], lubricant, and emulsifier | PO/EO (70/30) random copolymer glycerol ether, molecular weight 3,000 | 55 | 55 | | 55 | |
| | PO/EO (50/50) random copolymer gylcerol ether, molecular weight 6,000 | 42 | 42 | | 42 | |
| | PO/EO (35/65) random copolymer glycerol ether, molecular weight 20,000 | | | 97 | | |
| | PO/EO (60/40) random copolymer pentaerythritol ether, molecular weight 3,000 | | | | | 87 |
| | POE (30) castor oil | | | | | 10 |

TABLE 3-continued

| | Composition | | Example of the present invention | | Comparative example | | |
|---|---|---|---|---|---|---|---|
| | | | 10 | 11 | 13 | 14 | 15 |
| | ether | | | | | | |
| [B] | [I] | (b-1)-1 | 1.0 | 1.5 | 1.0 | | |
| | [II] | II-2 | | 1.0 | | | 1.5 |
| | | II-3 | 1.0 | | 1.0 | 1.0 | |
| [B] | [III] | III-1 | | 1.0 | 1.0 | | 1.5 |
| Others | Sodium lauryl sulfate | | | | | 2.0 | |
| Process-abiltiy | Scum deposits on the heater | | 0 | 0 | Δ~x | Δ | Δ~x |
| | Processing stability | | 0 | 0 | Δ | Δ~x | Δ~x |

(Note)
The symbols of compounds [I], [II], and [III] in component [B] are the same as in Table 1.

A can be seen from the results described above, compositions of the present invention in Examples 10 and 11 leaves scarcely recognizable scums on the heater, and provided the sufficient processing stability. In contrast, the composition of Comparative example 13 comprising a polyether in component [A] having a high molecular weight of 20,000, increased scum deposits on the heater and provided poor processing stability. The composition of Comparative example 14 containing 3% by weight of the anionic component, proposed in the specification of Japanese Patent Publication No. 52-47079 (1977), deposited large amounts of scums and provided poor processing stability due to the absence of component [B]-[I]. The composition of Comparative example 15 containing 3% by weight of the anionic component, proposed in the specification of Japanese Patent Laid-open No. 50-155796 (1975), deposited large amounts of scums on the heater and provided poor processing stability due to the absence of component [B]-[I] and 10% by weight of a nonionic surfactant.

EXAMPLES 12-16 AND COMPARATIVE EXAMPLES 16-27

The operation as in Examples 1-6 was repeated except that compositions shown in Table 4 as 10 weight % aqueous emulsions were applied to a polyester filamentary yarns. The results obtained are shown in Table 4.

TABLE 4

| | | | Example of the present invention | | | | | Comparative example | | | | | | | | | | | |
|---|---|---|---|---|---|---|---|---|---|---|---|---|---|---|---|---|---|---|---|
| | Composition | | 12 | 13 | 14 | 15 | 16 | 16 | 17 | 18 | 19 | 20 | 21 | 22 | 23 | 24 | 25 | 26 | 27 |
| Component [A], lubricant, and emulsifier | PO/EO (50/50) random copolymer butyl ether, molecular weight 2,000 | | 96.1 | 97.4 | | 98.3 | 97.0 | 50.0 | | 97.0 | | | | | 86.1 | 92.5 | 95.0 | | |
| | PO/EO (70/30) random copolymer glycerol ether, molecular weight 3,000 | | | | 67.9 | | | | 50.0 | | 92.0 | 92.0 | | | | | | | |
| | PO/EO (50/50) random copolymer glycerol ether, molecular weight 6,000 | | | | 30.0 | | | 47.0 | 47.0 | | | | | 96.1 | | | | | |
| | PO/EO (50/50) random copolymer butyl ether, molecular weight 500 | | | | | | | | | | | | 97.0 | | | | | | |
| | Polyethylene oxide, molecular weight 2,000 | | | | | | | | | | | | | | | | | | |
| | Diisotridecyl adipate | | | | | | | | | | | | | | | | | 60.0 | |
| | Mineral oil 120″ | | | | | | | | | | | | | | | | | | 60.0 |
| | POE (5) nonyl phenol ether | | | | | | | | | | | | | | | | | | 37.0 |
| | POE (3) oleyl ether | | | | | | | | | | | | | | | | | | 13.0 |
| | POE (8) oleyl ether | | | | | | | | | | | | | | | | | 24.0 | |
| | POE (15) stearyl ether | | | | | | | | | | 5.0 | 5.0 | | | 10.0 | | | | |
| [B] | [I] | (b-2)-1 | 1.3 | | | | | | | | | | | 1.3 | 1.3 | | | 1.0 | 1.0 |
| | [All belonged to group (b-2).] | (b-2)-2 | | 1.5 | | | 1.0 | | | | | | 1.0 | | | 2.5 | | | |
| | | (b-2)-3 | | | 0.7 | | | | | | | | | | | | 5.0 | | |
| | | (b-2)-4 | | | | 0.5 | | | | | | | | | | | | | |
| | [II] | II-1 | | 1.0 | | | | 3.0 | | | | | | 1.3 | 1.3 | | | | |
| | | II-2 | 1.3 | | 0.7 | | 1.0 | | | 1.5 | | | 1.0 | | | 2.5 | | 1.0 | |
| | | II-3 | | | | 1.2 | | | | | 3.0 | | | | | | | | 1.0 |
| | [III] | III-1 | 1.3 | | | | | | 3.0 | 1.5 | | | | 1.3 | 1.3 | 2.5 | | 1.0 | 1.0 |
| | | III-2 | | | 0.7 | | 1.0 | | | | | 3.0 | 1.0 | | | | | | |
| Process-ability | Scum deposits on the heater | 0 | 0 | | 502 | 0 | Δ | Δ | Δ | Δ~x | Δ~x | Δ | 0 smoking | x | Δ | Δ | x | x | |
| | Processing stability | 0 | 0 | 0 | 0 | 0 | x | Δ~x | x | x | x | Δ | x | Δ~x | 0~Δ | Δ | x | x | |

(Notes)
Compounds [I] in component [B] are described below, and the symbols of compounds [II] and [III] are the same as in Table 1.
Compounds of group (b-2):
(b-2)-1: disodium lauryloxysuccinate
(b-2)-2: dipotassium palmitoylsuccinate
(b-2)-3: dipotassium laurylthiosuccinate
(b-2)-4: dipotassium salt of palmitoylsuccinic acid ester with lactic acid.

As can be seen from the results described above, compositions in Examples 12–16 leaves scarcely recognizable amounts of scums on the heater, and provided the sufficient processing stability. In contrast, compositions in Comparative examples 16–27 increased scum deposits on the heater and provided the insufficient processing stability. On closer examination of comparative examples, compositions in Comparative examples 16–18 deteriorated the processing stability considerably because of the absence of component [I], and deposited large amounts of scums on the heater due to only the effect of reduced anionic component. Scum deposits on the heater were further increased in Comparative examples 19 and 20 wherein polyethers in compositions of Comparative examples 16–18 were partly replaced by a nonionic surfactant. Scum deposits on the heater were increased in Comparative example 21, wherein the polyether was a polyethylene oxide, as clearly distinguished from the present invention. In Comparative example 22, wherein the polyether of the present invention 12 was replaced by a low-molecular weight polyether, scum deposits on the heater were decreased; however, the processing stability (operating efficiency) was poor with increased smoking. In Comparative example 23, wherein the polyether in Example 12 of the present invention was partly replaced by a nonionic surfactant, scum deposits on the heater were increased. The composition in Comparative example 24 having the same combination as the components of the present invention increased scum deposits on the heater slightly due to the large amount of the anionic component beyond the upper limit of the present invention. The composition in Comparative example 25 comprising the anionic component of compound [I] alone gave merely almost the same results as in Comparative example 24. Mineral oil and esters used instead of polyethers in Comparative examples 26 and 27 increased scum deposits on the heater in a short time to make the texturing operation extremely difficult. Thus, as is evident from the examples of the present invention, a combination of compounds [I] and [II], [I] and [III], or [I], [II], and [III] as component [B] produced the unexpectable synergistic effects.

EXAMPLES 17 AND 18

The operation as in Example 7–9 was repeated except that compositions shown in Table 5 as 10 weight % aqueous emulsions were applied to a polyester filamentary yarn. The results obtained are shown in Table 5.

TABLE 5

| Component | Composition | | Example of the present invention 17 | | 18 | |
|---|---|---|---|---|---|---|
| [A] | PO/EO (70/30) random copolymer butyl ether, molecular weight 3,000 | | 60 | | | |
| | PO/EO (50/50) random copolymer glycerol ether, molecular weight 8,000 | | 36 | | | |
| | PO/EO (50/50) random copolymer butyl ether, molecular weight 3,000 | | | | 55 | |
| | PO/EO (50/50) random copolymer glycerol ether, molecular weight 6,000 | | | | 42 | |
| [B] | [I] | (b-2)-1 | 1.3 | | | |
| | | (b-2)-2 | | | 1.0 | |
| | [II] | II-1 | | | 1.0 | |
| | | II-3 | 1.3 | | | |
| | [III] | III-1 | 1.3 | | | |
| | | III-2 | | | 1.0 | |
| Processability | Solid content of the treating agent (% by weight) | | 0.29 | 0.68 | 0.38 | 0.62 |
| | Scum deposits on the heater | | 0 | Δ | 0 | Δ ~ 0 |

(Note)
Symbols of compounds in component [B] are the same as in Table 4.

As is evident from the results in Table 4, the solid content in the range of 0.1 to 0.5% by weight leaves scarcely recognizable scums on the heater with the good processability.

In contrast, the solid content higher than 0.5% by weight tended to increase scum deposits on the heater even in the case of the treating composition of the present invention.

EXAMPLES 19–20, AND COMPARATIVE EXAMPLES 28–30

The operation as in Examples 7–9 was repeated except that compositions shown in Table 6 as 10 weight % aqueous emulsions were applied to a polyester filamentary yarn to give a solid content of 0.3% by weight. The results are shown in Table 6.

TABLE 6

| | Composition | | Example of the present invention 19 | 20 | Comparative example 28 | 29 | 30 |
|---|---|---|---|---|---|---|---|
| Component [A], lubricant, and emulsifier | PO/EO (70/30) random copolymer glycerol ether, molecular weight 3,000 | | 55 | 55 | | 55 | |
| | PO/EO (50/50) random copolymer glycerol ether, molecular weight 6,000 | | 42 | 42 | | 42 | |
| | PO/EO (35/65) random copolymer glycerol ether, molecular weight 20,000 | | | | 97 | | |
| | PO/EO (60/40) random copolymer pentaerythritol ether, molecular weight 3,000 | | | | | | 87 |
| | POE (30) castor oil ether | | | | | | 10 |
| [B] | [I] | (b-2)-2 | 1.0 | 1.5 | 1.0 | | |
| | [II] | II-1 | 1.0 | | 1.0 | 1.0 | |
| | | II-2 | | 1.0 | | | 1.5 |
| | [III] | III-1 | | 1.0 | 1.0 | | 1.5 |
| Others | Sodium lauryl sulfate | | | | | 2.0 | |
| Processability | Scum deposits on the heater | | 0 | 0 | Δ ~ x | Δ | Δ ~ x |
| | Processing stability | | 0 | 0 | Δ | Δ ~ x | Δ ~ x |

(Note)
Symbols of compounds in component [B] are the same as in Table 4.

As is evident from the results described above, compositions of the present invention in Examples 19 and 20 leaves extremely small amounts of scums of the heater with the sufficient processing stability. In contrast, the composition in Comparative example 28 comprising a polyether having a high molecular weight of 20,000 increased scum deposits on the heater with the poor processing stability. The composition in Comparative example 29 containing 3% by weight of the anionic component described in Japanese Patent Publication No. 52-47079 (1977), deposited much scums on the heater with the poor processing stability due to the absence of component [B]-[I]. The composition of Comparative example 30 containing 3% by weight of the anionic component proposed in Japanese Patent Laid-open No. 50-155796 (1975) increased scum deposits on the heater with the poor processing stability due to the absence of component [B]-[I] and 10% by weight of a nonionic surfactant.

EXAMPLES 21-25 AND COMPARATIVE EXAMPLES 31-42

The operation as in Examples 1-6 was repeated except that compositions shown in Table 7 as 10 weight % aqueous emulsions were applied to a polyester filamentary yarn. The results obtained are shown in Table 7.

TABLE 7

| | Composition | | Example of the present invention | | | | | Comparative example | | | |
|---|---|---|---|---|---|---|---|---|---|---|---|
| | | | 21 | 22 | 23 | 24 | 25 | 31 | 32 | 33 | 34 |
| Component [A], lubricant, and emulsifier | PO/EO (50/50) random copolymer butyl ether, molecular weight 2,000 | | 96.1 | 97.4 | | 98.5 | 97.0 | 50.0 | | 97.0 | |
| | PO/EO (70/30) random copolymer glycerol ether, molecular weight 3,000 | | | | 68.0 | | | | 50.0 | | 92.0 |
| | PO/EO (50/50) random copolymer glycerol ether, molecular weight 6,000 | | | | 30.0 | | | 47.0 | 47.0 | | |
| | PO/EO (50/50) random copolymer butyl ether, molecular weight 500 | | | | | | | | | | |
| | Polyethylene oxide, molecular weight 2,000 | | | | | | | | | | |
| | Diisotridecyl adipate | | | | | | | | | | |
| | Mineral oil 120" | | | | | | | | | | |
| | POE (5) nonyl phenol ether | | | | | | | | | | |
| | POE (3) oleyl ether | | | | | | | | | | |
| | POE (8) oleyl ether | | | | | | | | | | |
| | POE (15) stearyl ether | | | | | | | | | | 5.0 |
| Component [B] | [I] [All used belonged to group (b-3).] | (b-3)-1 | 1.3 | | | | | | | | |
| | | (b-3)-2 | | 1.3 | | 0.5 | | | | | |
| | | (b-3)-3 | | | 0.7 | | | | | | |
| | | (b-3)-4 | | | | | 1.0 | | | | |
| | [II] | II-1 | 1.3 | 1.3 | | | | 3.0 | | | |
| | | II-2 | | | 0.7 | | 1.0 | | | 1.5 | |
| | | II-3 | | | | 1.0 | | | | | 3.0 |
| | [III] | III-1 | 1.3 | | | | | | 3.0 | 1.5 | |
| | | III-2 | | | 0.6 | | 1.0 | | | | |
| Processability | Scum deposits on the heater | | 0 | 0 | ◎ | ◎ | ◎ | Δ | Δ | Δ | Δ ~ x |
| | Processing stability | | 0 | 0 | 0 | 0 | 0 | x | Δ ~ x | x | x |

| | Composition | | Comparative example | | | | | | | |
|---|---|---|---|---|---|---|---|---|---|---|
| | | | 35 | 36 | 37 | 38 | 39 | 40 | 41 | 42 |
| Component [A], lubricant, and emulsifier | PO/EO (50/50) random copolymer butyl ether, molecular weight 2,000 | | | | | 86.1 | 92.5 | 95.0 | | |
| | PO/EO (70/30) random copolymer glycerol ether, molecular weight 3,000 | | 92.0 | | | | | | | |
| | PO/EO (50/50) random copolymer glycerol ether, molecular weight 6,000 | | | | | | | | | |
| | PO/EO (50/50) random copolymer butyl ether, molecular weight 500 | | | | 96.1 | | | | | |
| | Polyethylene oxide, molecular weight 2,000 | | | 97.0 | | | | | | |
| | Diisotridecyl adipate | | | | | | | | 60.0 | |
| | Mineral oil 120" | | | | | | | | | 60.0 |
| | POE (5) nonyl phenol ether | | | | | | | | 37.0 | |
| | POE (3) oleyl ether | | | | | | | | | 13.0 |
| | POE (8) oleyl ether | | | | | | | | | 24.0 |
| | POE (15) stearyl ether | | 5.0 | | | 10.0 | | | | |
| Component [B] | [I] [All used belonged to group (b-3).] | (b-3)-1 | | | 1.3 | 1.3 | | | 1.0 | 1.0 |
| | | (b-3)-2 | | 1.0 | | | 2.5 | | | |
| | | (b-3)-3 | | | | | | 5.0 | | |
| | | (b-3)-4 | | | | | | | | |
| | [II] | II-1 | | | 1.3 | 1.3 | | | | |
| | | II-2 | | 1.0 | | | 2.5 | | 1.0 | |
| | | II-3 | | | | | | | | 1.0 |
| | [III] | III-1 | | | 1.3 | 1.3 | 2.5 | | 1.0 | 1.0 |
| | | III-2 | 3.0 | 1.0 | | | | | | |
| Processability | Scum deposits on the heater | | Δ ~ x | Δ | 0 smoking | x | Δ | Δ | x | x |

TABLE 7-continued

| | | | | | | | | |
|---|---|---|---|---|---|---|---|---|
| Processing stability | x | Δ | x | Δ ~ x | 0 ~ Δ | Δ | x | x |

(Notes)
Compounds [I] in component [B] are described below, and the symbols of compounds [II] and [III] are the same as in Table 1.
Compounds of group (b-3):
(b-3)-1: disodium N—lauryl glutamate
(b-3)-2: dipotassium N—octanoyl aspartate
(b-3)-3: disodium N—perfluorooctanesulfonylglutamate
(b-3)-4: dipotassium salt of N—lauroylglutamic acid ester with lactic acid As mentioned in Table 7, compositions in Examples 21–25 of the present invention leaves scarcely recognizable scums on the heater with the sufficient processing stability. In contrast, compositions in Comparative examples 31–42 increased scum deposits on the heater with the insufficient processing stability. On closer examination of comparative examples, compositions in Comparative examples 31–33 deteriorated the processing stability considerably because of the absence of component [I], and deposited large amounts of scums on the heater due to only the effect of reduced anionic component. Scum deposits were further increased in Comparative examples 34 and 35 wherein polyethers in compositions of Comparative examples 31–33 were partly replaced by a nonionic surfactant. Scum deposits were increased in Comparative example 36 wherein the polyether was a polyethylene oxide, as clearly distinguished from the present invention. In Comparative example 37 wherein the polyether in Example 21 of the present invention was replaced by a low-molecular weight polyether, scum deposits on the heater were decreased; however, the processing stability (operating efficiency) was poor with increased smoking. In Comparative example 38, wherein the polyether in Example 21 of the present invention was partly replaced by a nonionic surfactant, scum deposits on the heater were increased. The composition in Comparative example 39 having the same combination as the components of the present invention increased scum deposits slightly due to the large amount of the anionic component beyond the upper limit of the present invention. The composition in Comparative example 40 comprising the anionic component of compound [I] alone gave merely almost the same results as in Comparative example 39. Mineral oil and esters used instead of polyethers in Comparative examples 41 and 42 increased scum deposits in a short time to make the texturing operation extremely difficult. Thus, as is evident from the examples of the present invention, a combination of compounds [I] and [II], [I] and [III] or [I], [II], and [III], produced unexpectable synergistic effects.

EXAMPLES 26–28

The operation as in Examples 7–9 was repeated except that compositions shown in Table 8 as 10 weight % aqueous emulsions were applied to a polyester filamentary yarn. The results obtained are shown in Table 8.

TABLE 8

| Component | Composition | | Example of the present invention 26 | | 27 | | 28 | |
|---|---|---|---|---|---|---|---|---|
| [A] | PO/EO (70/30) random copolymer butyl ether, molecular weight 3,000 | | 55 | | | | | |
| | PO/EO (50/50) random copolymer glycerol ether, molecular weight 8,000 | | 42 | | | | | |
| | PO/EO (50/50) random copolymer butyl ether, molecular weight 3,000 | | | | 60 | | 60 | |
| | PO/EO (50/50) random copolymer glycerol ether, molecular weight 6,000 | | | | 37 | | 37 | |
| [B] | [I] | (b-3)-1 | 1.5 | | 1.0 | | | |
| | | (b-3)-4 | | | | | 1.3 | |
| | [II] | II-1 | | | 1.0 | | | |
| | | II-2 | 1.0 | | | | 1.3 | |
| | [III] | III-1 | 1.0 | | 1.0 | | | |
| | | III-2 | | | | | 1.3 | |
| Process-ability | Solid content of the treating agent (% by weight) | | 0.31 | 0.70 | 0.39 | 0.64 | 0.35 | 0.65 |
| | Scum deposits on the heater | | 0 | Δ ~ 0 | 0 | Δ | 0 | Δ |

(Note)
Symbols of compounds in component [B] are the same as in Table 7.

As is evident from the results described above, the solid content in the range of 0.1 to 0.5% by weight leaves extremely small amounts of scums with good processability. In contrast, the solid content higher than 0.5% by weight tended to increase scum deposits even in the case of the treating composition of the present invention.

EXAMPLES 29–30 AND COMPARATIVE EXAMPLES 43–45

The operation as in Examples 7–9 was repeated except that compositions shown in Table 9 as 10 weight % aqueous emulsions were applied to polyester filamentary yarns. The results obtained are shown in Table 9.

TABLE 9

| | Composition | Example of the present invention 29 | 30 | Comparative example 43 | 44 | 45 |
|---|---|---|---|---|---|---|
| Component [A] | PO/EO (70/30) random copolymer glycerol ether, molecular weight 3,000 | 55 | 55 | | 55 | |

TABLE 9-continued

| | Composition | | Example of the present invention | | Comparative example | | |
|---|---|---|---|---|---|---|---|
| | | | 29 | 30 | 43 | 44 | 45 |
| lubricant, and emulsifier | PO/EO (50/50) random copolymer glycerol ether, molecular weight 6,000 | | 42 | 42 | | 42 | |
| | PO/EO (35/65) random copolymer glycerol ether, molecular weight 20,000 | | | | 97 | | |
| | PO/EO (60/40) random copolymer pantaerythritol ether, molecular weight 3,000 | | | | | | 87 |
| | POE (30) castor oil ether | | | | | | 10 |
| Component [B] | [I] | (b-3)-1 | 1.5 | 1.0 | 1.0 | | |
| | [II] | II-2 | | 1.0 | | | 1.5 |
| | | II-3 | 1.0 | | 1.0 | 1.0 | |
| | [III] | III-2 | | 1.0 | 1.0 | | 1.5 |
| Others | Sodium lauryl sulfate | | | | | 2.0 | |
| Processability | Scum deposits on the heater | | 0 | 0 | Δ ~ x | Δ | Δ ~ x |
| | Processing stability | | 0 | 0 | Δ | Δ ~ x | Δ ~ x |

(Note)
Symbols of compounds in component [B] are the same as in Table 7.

As is evident from the results described above, compositions of Examples 29 and 30 leaves extremely small amounts of scums with the sufficient processing stability. In contrast, the composition in Comparative example 43 comprising a polyether having a high molecular weight of 20,000 increased scum deposits with the poor processing stability. The composition in Comparative example 44 containing 3% by weight of the anionic component described in Japanese Patent Publication No. 52-47079 (1977), deposited much scums on the heater with the poor processing stability due to the absence of component [B]-[I]. The composition of Comparative example 45 containing 3% by weight of the anionic component proposed by Japanese Patent Laid-open No. 50-155796 (1975) increased scum deposits with the poor processing stability due to the absence of anionic component and 10% by weight of a nonionic surfactant.

What is claimed is:

1. A yarn treating composition for high-speed friction draw-false twist texturing comprising substantially (A) a polyether lubricant component and (B) an anionic component, wherein (A) said polyether lubricant component consists of one or two or more types of random or block copolymers having a molar copolymerization ratio between propylene and ethylene oxides of 35:65–90:10, and an average molecular weight in the range of 1,000 to 15,000, both inclusive, and is incorporated in the composition in an amount of 96% by weight or more, and (B) said anionic component is a mixture (C) of compounds I and II, I and III, or I, II and III, said compounds being defined below and said mixture being incorporated in the composition in amounts ranging from 0.5% to 4.0% by weight, said compound I being selected from the following groups (b-1), (b-2) and (b-3):

(b-1): alkali metal, ammonium, organic amine salts or their mixtures of long-chain monoolefinic dicarboxylic acids, obtained by addition of long-chain monoolefin having 8 to 18 carbon atoms with at least one of dicarboxylic acids having double bonds, anhydrides thereof and ester derivatives thereof, each having at least one carboxyl group in the molecule, obtained by reacting said long-chain monoolefinic dicarboxylic acids or the corresponding dicarboxylic acid anhydrides with compounds having one or more hydroxyl groups in the molecule, (b-2): selected from (a), (b) or a mixture of (a) and (b), wherein (a) and (b) are:

(a) alkali metal, ammonium or organic amine salts of dicarboxylic derivatives having long-chain alkyl ethers, long-chain alkyl thioethers or long-chain alkyl ketone groups, obtained by reacting dicarboxylic acids having double bonds, anhydrides, or diesters thereof, with compounds having active hydrogen atoms selected from the group consisting of aliphatic alcohols, aliphatic alkyl mercaptans, and aliphatic aldehydes having 8 to 18 carbon atoms on the average;

(b) alkali metal, ammonium or organic amine salts of ester commpounds having at least one carboxyl group, obtained by reacting said dicarboxylic derivatives having long-chain alkyl ethers, long-chain thioethers or long-chain alkyl ketone groups with compounds each having at least one hydroxyl group in the molecule, (b-3): alkali metal, ammonium, alkanolamine or alkylamine salts of compounds of the general formula $$R-Z-NH.\underset{\underset{(CH_2)_n-COOH}{|}}{CH}-COOH$$

where R is an alkyl, alkenyl, or fluoroalkyl group having 8 to 22 carbon atoms; n is a positive integer 1 or 2; Z is —CO— or —$SO_2$—, obtained by reacting amino-dicarboxylic acids or derivatives thereof with at least one of aliphatic acyl halides, sulfochlorides, and alkali metal, ammonium or organic amine salts of ester compounds each having at least one carboxylic group, obtained from esterification of said compounds defined above or anhydrides thereof with compounds having at least one hydroxyl group in the molecule;

compounds (II): alkali metal, ammonium or organic amine salts of phosphates having higher alkyl or aralkyl polyoxyalkylene ether groups; and compounds (III): amine, organic amine or alkali metal salts of sulfonate compounds each having at least one alkyl group and sulfonic acid group respectively in the molecule.

2. A yarn treating composition for high-speed friction draw-false twist texturing according to claim 1, wherein component [A] is a mixture of polyethers having a molecular weight of about 1,000 to about 4,000 and of about 5,000 to about 15,000, respectively.

3. A yarn treating composition for high-speed friction draw-false twist texturing according to claim 1, wherein mixture (C) is incorporated in the composition in amounts ranging from 1.0 to 3.0 by weight.

4. A polyester filamentary yarn for high-speed friction draw-false twist texturing wherein 0.20 to 0.35% by weight of the yarn treating composition undermentioned is applied to a polyester multifilament yarn having a birefringence of 0.03 to 0.08 and an elongation of 30 to 250%:

said yarn treating composition comprising substantially (A) a polyether lubricant component and (B) an anionic component, wherein (A) said polyether lubricant component consists of one or two or more types of random or block copolymers having a molar copolymerization ratio between propylene and ethylene oxides of 35:65–90:10, and an average molecular weight in the range of 1,000 to 15,000, both inclusive, and is incorporated in the composition in an amount of 96% by weight or more, and (B) said anionic component is a mixture (C) of compounds I and II, I and III, or I, II and III, said compounds being defined below and said mixture being incorporated in the composition in amounts ranging from 0.5% to 4.0% by weight, said compound I being selected from the followinng groups (b-1), (b-2) and (b-3):

(b-1): alkali metal, ammonium, organic amine salts or their mixtures of long-chain monoolefinic dicarboxylic acids, obtained by addition of long-chain monoolefin having 8 to 18 carbon atoms with at least one of dicarboxylic acids having double bonds, anhydrides thereof and ester derivatives thereof, each having at least one carboxyl group in the molecule, obtained by reacting said long-chain monoolefinic dicarboxylic acids or the corresponding dicarboxylic acid anhydrides with compounds having one or more hydroxyl groups in the molecule, (b-2): selected from (a), (b) or a mixture of (a) and (b), wherein (a) and (b) are:

(a) alkali metal, ammonium or organic amine salts of dicarboxylic derivatives having long-chain alkyl ethers, long-chain alkyl thioethers or long-chain alkyl ketone groups, obtained by reacting dicarboxylic acids having double bonds, anhydrides, or diesters thereof, with compounds having active hydrogen atoms selected from the group consisting of aliphatic alcohols, aliphatic alkyl mercaptans, and aliphatic aldehydes having 8 to 18 carbon atoms on the average;

(b) alkali metal, ammonium or organic amine salts of ester compounds having at least one carboxyl group, obtained by reacting said dicarboxylic derivatives having long-chain alkyl ethers, long-chain thioethers or long-chain alkyl ketone groups with compounds each having at least one hydroxyl group in the molecule, (b-3): alkali metal, ammonium, alkanolamine or alkylamine salts of compounds of the general formula $$R-Z-NH.\underset{\underset{(CH_2)_n-COOH}{|}}{CH}-COOH$$

where R is an alkyl, alkenyl, or fluoroalkyl group having 8 to 22 carbon atoms; n is a positive integer 1 or 2; Z is —CO— or —$SO_2$—, obtained by reacting aminodicarboxylic acids or derivatives thereof with at least one of aliphatic acyl halides, sulfo-chlorides, and alkali metal, ammonium or organic amine salts of ester compounds each having at least one carboxylic group, obtained from esterification of said compounds defined above or anhydrides thereof with compounds having at least one hydroxyl group in the molecule;

compounds (II): alkali metal, ammonium or organic amine salts of phosphates having higher alkyl or aralkyl polyoxyalkylene ether groups; and compounds (III): amine, organic amine or alkali metal salts of sulfonate compounds each having at least one alkyl group and sulfonic acid group respectively in the molecule.

5. A polyester filamentary yarn for high-speed friction draw-false twist texturing according to claim 4, wherein said component [A] is a mixture of polyethers having a molecular weight of about 1,000 to about 4,000 and of about 5,000 to about 15,000, respectively.

6. A polyester filamentary yarn for high-speed friction draw-false twist texturing according to claim 4, wherein said mixture (C) are incorporated in the composition in amounts ranging from 1.0% by weight to 3.0% by weight.

* * * * *